US005419137A

United States Patent [19]

Sweeney et al.

[11] Patent Number: 5,419,137

[45] Date of Patent: May 30, 1995

[54] AIR SEPARATION PROCESS AND APPARATUS FOR THE PRODUCTION OF HIGH PURITY NITROGEN

[75] Inventors: Paul A. Sweeney, Basking Ridge; Ramachandran Krishnamurthy, Piscataway, both of N.J.

[73] Assignee: The BOC Group, Inc., New Providence, N.J.

[21] Appl. No.: 107,433

[22] Filed: Aug. 16, 1993

[51] Int. Cl.[6] ..... F25J 3/02

[52] U.S. Cl. ..... 62/25; 62/38

[58] Field of Search ..... 62/24, 25, 38

[56] References Cited

U.S. PATENT DOCUMENTS

| | | | |
|---|---|---|---|
| 3,756,035 | 9/1973 | Yearout | 62/22 |
| 4,543,115 | 9/1985 | Agrawal et al. | 62/25 |
| 4,617,036 | 10/1986 | Suchdeo et al. | 62/11 |
| 4,843,828 | 7/1989 | Gladman | 62/24 |
| 5,006,139 | 4/1991 | Agrawal et al. | 62/24 |
| 5,049,173 | 9/1991 | Cormier, Jr. et al. | 62/38 |

*Primary Examiner*—Ronald C. Capossela

*Attorney, Agent, or Firm*—David M. Rosenblum; Larry R. Cassett

[57] ABSTRACT

A process and apparatus for producing a high purity nitrogen vapor product from the rectification of air within high and low pressure columns operatively associated with one another by a condenser-reboiler. The high pressure column incorporates a sufficient number of theoretical stages to produce a high purity nitrogen vapor which after being condensed by the condenser-reboiler, serves to partially condense a lower purity nitrogen vapor tower overhead produced in the low pressure column through indirect heat exchanger. In such service, the condensed, high purity nitrogen vapor is at least partially vaporized and utilized as a product stream. Since there is no direct heat exchange with the high purity nitrogen produced within the high pressure column and the lower purity nitrogen vapor produced in the low pressure column, the low pressure column can incorporate fewer theoretical stages and therefore can be built at less expense than similar air separation plants of the prior art.

6 Claims, 1 Drawing Sheet

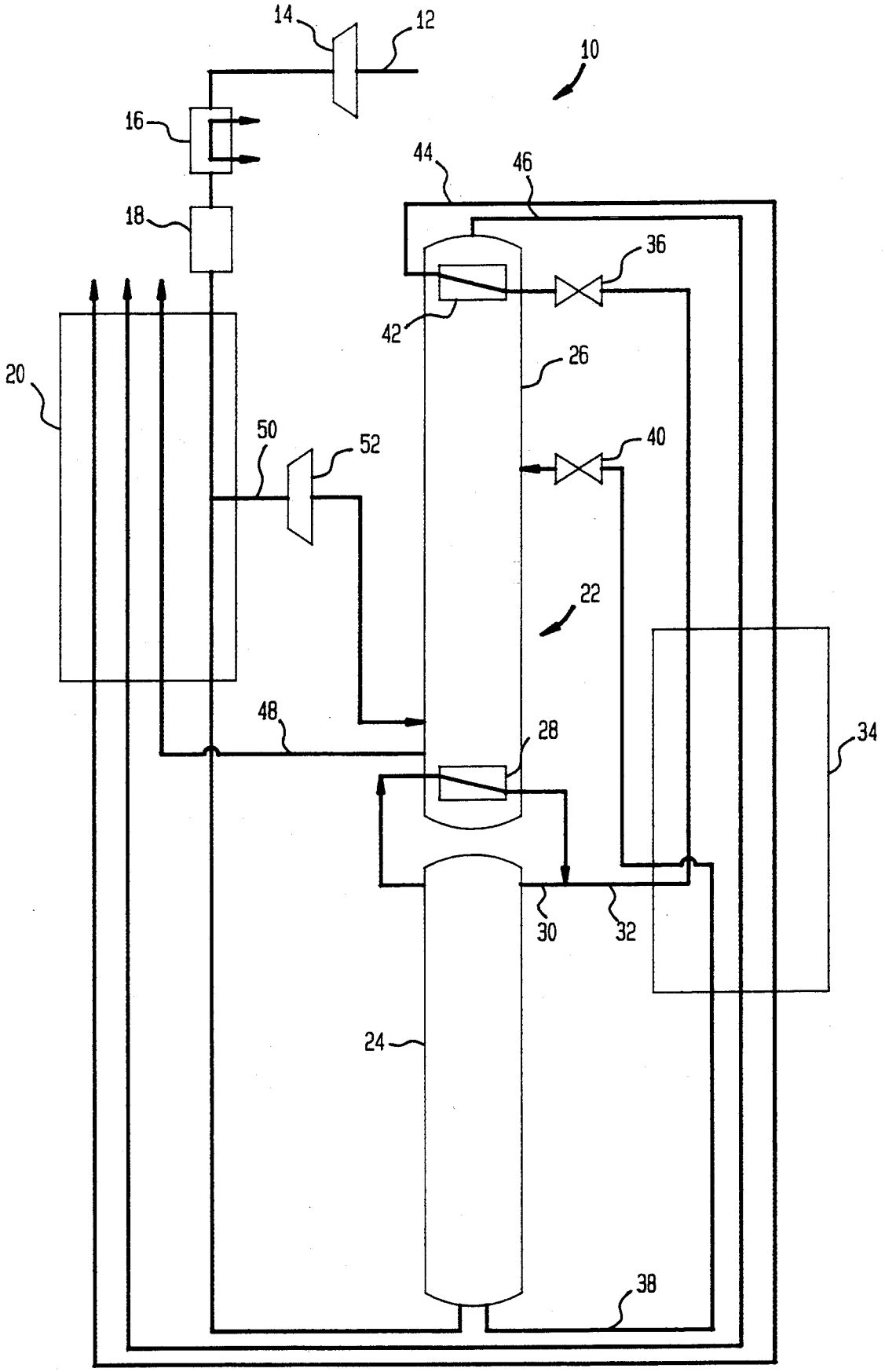
14
12
10
16
44
46
18
36
42
26
20
50
52
40
22
48
28
34
30
32
24
38

AIR SEPARATION PROCESS AND APPARATUS FOR THE PRODUCTION OF HIGH PURITY NITROGEN

BACKGROUND OF THE INVENTION

The present invention relates to an air separation process and apparatus for producing high purity nitrogen. More particularly, the present invention relates to such a process and apparatus in which compressed, purified, and cooled air is separated in an air separation unit incorporating high and low pressure columns. Even more particularly, the present invention relates to such a process and apparatus in which the high purity nitrogen is produced in the high pressure column and reflux is supplied to the low pressure column through indirect heat exchange between the high purity nitrogen and tower overhead produced in the low pressure column.

Many industrial processes require high purity nitrogen. For instance, the semiconductor industry uses high purity nitrogen as a carrier gas, a drydown gas, an inerting gas, and etc. High purity nitrogen is produced through the cryogenic distillation or rectification of the air in one or more columns. When oxygen production is also required, an air separation trait is utilized that has high and low pressure columns operatively associated with one another in a heat transfer relationship by a condenser-reboiler. In such apparatus, air after having been compressed, purified and cooled to near dewpoint temperatures is introduced into the bottom of the high pressure column. In either of the columns, contacting elements such as trays, plates, packing, either structured or random, are used to bring an ascending vapor phase into intimate contact with a descending liquid phase. As a result of such contact, the ascending vapor phase has an ever increasing nitrogen concentration as it ascends within the column and the descending liquid phase has an ever increasing oxygen concentration as it descends within the column. In the high pressure column, an oxygen-enriched column bottom is produced and a high purity nitrogen vapor tower overhead is produced. The high purity nitrogen vapor tower overhead is condensed against boiling liquid oxygen produced within the low pressure column to supply reflux for both the high and low pressure columns.

In order to utilize the high purity nitrogen vapor tower overhead to supply reflux to the low pressure column the low pressure column must also produce a high purity nitrogen vapor tower overhead and as such, the low pressure column must incorporate a sufficient height of packing or a sufficient number of trays or plates to produce the required nitrogen refinement. Thus, part of the initial capitalization of a double column high purity nitrogen plant is expanded in the construction of a low pressure column designed to produce high purity nitrogen.

As will he discussed, the present invention provides a process and apparatus for producing a high purity nitrogen product through the separation of air in a double column air separation unit that does not require the production of high purity nitrogen in the low pressure column. This allows a low pressure column of the present invention to be constructed with less packing or fewer trays than similar columns of the prior art. The advantage of this can be realized in reduced plant construction costs.

SUMMARY OF THE INVENTION

The present invention provides a process for producing a high purity nitrogen vapor product from the rectification of air. The method comprises compressing the air, removing heat of compression from the air and then purifying the air. The air is then cooled to a temperature suitable for its rectification in a main heat exchanger. The air is rectified in a high pressure column of a double column air separation unit such that a crude liquid oxygen column bottom and a high purity nitrogen vapor tower overhead are formed. The crude liquid oxygen column bottom is further refined in a low pressure column of the double column air separation unit such that a liquid oxygen column bottom and a nitrogen-rich tower overhead are formed. The nitrogen-rich tower overhead has a higher concentration of oxygen than the high purity nitrogen vapor tower overhead produced in the high pressure column. Reflux is supplied to the high pressure column by condensing the high purity nitrogen vapor tower overhead against vaporizing the liquid oxygen. First and second subsidiary streams composed of the condensed high purity nitrogen vapor tower overhead are withdrawn and the first subsidiary stream is introduced into the high pressure column as the reflux. Reflux is also supplied to the low pressure column by indirectly exchanging heat between the second subsidiary stream and the nitrogen-rich tower overhead in the low pressure column such that the second subsidiary stream at least partially vaporizes to form the high purity nitrogen vapor stream and the nitrogen-rich tower overhead partially condenses. The crude liquid oxygen column bottom is further refined in the low pressure column and the second subsidiary stream is subcooled through indirect heat exchange with the high purity nitrogen vapor stream so that the high purity nitrogen vapor stream partially warms. Refrigeration is supplied to the process such that heat balance of the process is maintained. After utilizing the high purity nitrogen vapor stream for the subcooling of the crude liquid oxygen and second subsidiary streams, the high purity nitrogen vapor stream is introduced into the main heat exchanger and withdrawn as the high purity nitrogen vapor product. It is understood that the product could be further treated as, for instance, liquefaction.

In another aspect, the present invention provides an apparatus for separating air to produce a gaseous nitrogen product of high purity. The apparatus comprises a means for compressing the air and an aftercooler corrected to the compressor means for removing heat of compression from the air. A purification means is provided for purifying the air and a main heat exchange means is provided for cooling the air to a temperature suitable for its rectification and for fully warming to ambient temperature a high purity nitrogen vapor stream comprising the gaseous nitrogen product of high purity. An air separation unit is provided for rectifying the air. The air separation unit has high and low pressure columns operatively associated with one another in a heat transfer relationship by provision of a condenser-reboiler. Each of the high and low pressure columns has contacting elements for contacting an ascending vapor phase having an ever increasing nitrogen concentration as it ascends with a descending liquid phase having an ever increasing oxygen concentration as it descends.

The high pressure column is connected to the main heat exchange means so as to receive the air and has a sufficient number of theoretical stages of separation provided by the contacting elements such that the high purity nitrogen vapor tower overhead and a crude liquid oxygen column bottom are produced in the high pressure column from the rectification of the air. The high purity nitrogen vapor tower overhead is condensed against vaporization of the liquid oxygen produced in the low pressure column by the condenser-reboiler. The high pressure column is also connected to the condenser-reboiler so that a first subsidiary stream, composed of the high purity nitrogen vapor tower overhead, flows into the high pressure column as reflux. The low pressure column is connected to the high pressure column so as to receive a crude liquid oxygen stream composed of the crude liquid oxygen column bottom.

The low pressure column has a sufficiently low number of theoretical stages of separation provided by the contacting elements such that a lower purity nitrogen vapor tower overhead and a liquid oxygen column bottom are produced. The lower purity nitrogen vapor tower overhead has a higher concentration of oxygen than the high purity nitrogen vapor tower overhead produced in the high pressure column. A condensing means is connected to the condenser-reboiler and the low pressure column for at least partially vaporizing a second subsidiary stream, composed of the condensed high purity nitrogen vapor tower overhead. Such condensation produces the high purity nitrogen vapor stream. The condensation is effected against partially condensing the lower purity nitrogen vapor tower overhead of the low pressure column through indirect heat exchange. A subcooling means is provided for indirectly exchanging heat between the high purity nitrogen vapor stream and the high purity nitrogen liquid and crude oxygen streams so that the high purity nitrogen vapor stream partially warms and the high purity nitrogen liquid and crude oxygen streams subcool. The subcooling means is connected to the main heat exchange means so that the high purity nitrogen vapor stream fully warms in the main heat exchange means.

The apparatus further includes a refrigeration means for adding refrigeration to the apparatus for maintaining the apparatus in heat balance. The refrigeration means can be a Lachman air stream, turboexpanded with the performance of work.

A central aspect of the present invention is that the concentration of the high purity nitrogen produced in the high pressure column is not coupled with the purity of nitrogen produced in the low pressure column. This is effected by indirect heat exchange of the high purity nitrogen vapor produced in the high pressure column with the nitrogen vapor tower overhead produced in the low pressure column. As a result, the nitrogen vapor tower overhead produced in the low pressure column can have a lower purity than the tower overhead of the high pressure column and therefore, the low pressure column can be constructed with less packing or fewer trays or plates than a similar prior art double column plant used in the production of high purity nitrogen and oxygen. It is to be noted that since more oxygen is going into the low pressure column tower overhead, less oxygen will be produced than in plants designed to produce a high purity tower overhead in the low pressure column. In many industrial applications, however, such oxygen is only required at a low output level.

It should be mentioned that the term "fully warmed" as used herein and in the claims means warmed to approximately ambient temperature. Also, as used herein and in the claims, the term "fully cooled" means cooled to the rectification temperature of the air. Temperature in between "fully cooled" and "fully warmed" is "partially cooled." Lastly, "high purity nitrogen" as used herein and in the claims means nitrogen containing no more than about 10 ppm of oxygen and about 1% argon.

BRIEF DESCRIPTION OF THE DRAWINGS

While the specification concludes with claims distinctly pointing out the subject matter that applicant regards as his invention, it is believed that the invention will be better understood when taken in conjunction with the accompanying sole FIGURE, which is a schematic of a process and apparatus in accordance with the present invention.

DETAILED DESCRIPTION

With reference to the FIGURE, an apparatus 10 in accordance with the present invention is illustrated. An air stream 12 after having been suitably filtered is compressed by a compressor 14. After the heat of compression is removed from air stream 12, by an aftercooler 16 (preferably a water cooled heat exchanger), air stream 12 is purified by a prepurification unit 18 (preferably adsorbent beds operating out of phase for regeneration and designed to remove $CO_2$ and hydrocarbons). Air stream 12 is then cooled within a main heat exchanger 20 from ambient temperature, down to a temperature suitable for its rectification, which in practice is at or near the dew point of air stream 12. Main heat exchanger 20 is of conventional plate-fin design. Air stream 12 is then introduced into an air separation trait 22 having high and low pressure columns 24 and 26 connected to one another by a condenser-reboiler 28.

Air stream 12 is introduced into the bottom of high pressure column 24. In either of the columns 24 or 26 contacting elements are provided (which can be structured packing, random packing, plates or trays) to contact ascending and descending phases. The ascending phase becomes more concentrated in nitrogen as it ascends and the descending liquid phase becomes more concentrated in oxygen as it descends. The result in high pressure column 24 is that an oxygen-enriched liquid column bottom collects and a nitrogen-rich vapor tower overhead collects. High pressure column 24 has either a sufficient height of packing or a sufficient number of trays to produce the high purity nitrogen vapor tower overhead. In the low pressure column, a liquid oxygen column bottom and a nitrogen-rich tower overhead are formed.

High purity nitrogen vapor tower overhead is condensed against evaporating the liquid oxygen column bottom through use of condenser-reboiler 28. This condensed high purity nitrogen is divided into first and second subsidiary streams 30 and 32. First subsidiary stream 30 supplies reflux to the high pressure column and second subsidiary stream 32 after having been subcooled hi a subcooler 34 is further reduced in temperature by an expansion provided by a Joule-Thompson valve 36. A crude liquid oxygen stream 38 is removed from the bottom of the high pressure column, subcooled within subcooler 34, reduced in pressure to the pressure of low pressure column 26 by a Joule-Thompson valve 40 and introduced into level of suitable concentration within low pressure column 26. Subcooler 34 is of conventional plate-fin design. The crude liquid oxygen stream 38 is thereby further refined within low pressure column 26.

Second subsidiary stream 32 after having been reduced in temperature, as described above, is passed through a head condenser 42 (of conventional plate-fin design) to partially condense the nitrogen-rich vapor tower overhead produced within low pressure column 26 through indirect heat exchange. The condensate thereby provides the reflux for low pressure column 26. This produces at least a partial vaporization of second subsidiary stream 32 to form a high purity nitrogen vapor stream 44. In addition, a waste nitrogen stream 46 composed of the nitrogen vapor tower overhead is also withdrawn from the top of the low pressure column 26. High purity nitrogen vapor stream 44 along with waste stream 46 is partially warmed within subcooler 34 against subcooling crude liquid oxygen stream 38 and second subsidiary stream 32. Afterwards, high purity nitrogen vapor stream 44 and waste nitrogen stream 46 are fully warmed within main heat exchanger 20. A gaseous oxygen stream 48 can be withdrawn from low pressure column 26 and also fully warmed within main heat exchanger 20.

As mentioned above, second subsidiary stream 32 is at least "partially vaporized." In the usual practice in accordance with the present invention, second subsidiary stream 32 would be fully vaporized. It would be partially vaporized where liquid was required for storage. In such case, the liquid component of second subsidiary stream after its partial vaporization would be separated therefrom by a phase separation tank.

The present invention contemplates that, as an alterative to head condenser 42, a stripping column could be connected to the top of low pressure column 26 in a heat transfer relationship therewith by provision of another condenser-reboiler. High purity nitrogen liquid in the form of second subsidiary stream 32 would be fed into the stripping column to remove hydrogen and other light components. The high purity nitrogen liquid introduced into the stripping column would fall in such column and would then vaporize against the partial condensation of the nitrogen-rich vapor tower overhead in an indirect heat exchange relationship. Therefore, in such a possible embodiment of the present invention, the other condenser-reboiler would serve as condensing means for partially condensing the nitrogen-rich vapor tower overhead of low pressure column 26 against the partial or full vaporization of high purity nitrogen liquid produced in the high pressure column.

In order to supply refrigeration to the process, a partial stream 50 is extracted form air stream 12 after it is partially warmed. Partial stream 50 is expanded within a turboexpander 52 and then introduced into low pressure column 26. In case of partial vaporization of second subsidiary stream 32, more refrigeration would have to be supplied by partial stream 50. A further point that should be noted that although the apparatus has been illustrated as an air expansion plant a nitrogen expansion plant in accordance with the present invention is another possible embodiment thereof.

EXAMPLE

The following is a calculated example in chart form of the operation of apparatus 10. In this example, high pressure column 24 is provided with 60 theoretical stages and low pressure column 26 is provided with 22 theoretical stages. In low pressure column 26 (going from the top to bottom of the column), crude liquid oxygen stream 38 is introduced at stage 3. Partial stream 50 is introduced at stage 6 and gaseous oxygen stream 48 is removed at tray 32. In the example, all temperatures are in degrees K, pressure is in barr, flow rate is in kg/hr and composition is by volume percent.

| Stream | Temperature | Pressure | Flow Rate | Composition |
|---|---|---|---|---|
| Air stream 12 after discharge from aftercooler 16 | 302.67 | 6.28 | 50300 | 78% Nitrogen<br>21% Oxygen<br>1% Argon |
| Air stream 12 after prepurification in purification unit 18 | 302.67 | 6.00 | 50300 | 78% Nitrogen<br>21% Oxygen<br>1% Argon |
| Air stream 12 after main heat exchanger 20 | 100.62 | 5.90 | 50300 | 78% Nitrogen<br>21% Oxygen<br>1% Argon |
| Partial stream 50 prior to expansion | 180.00 | 5.95 | 4074 | 78% Nitrogen<br>21% Oxygen<br>1% Argon |
| Partial stream 50 after expansion | 127.99 | 1.45 | 4074 | 78% Nitrogen<br>21% Oxygen<br>1% Argon |
| First subsidiary stream 30 | 95.0 | 5.65 | 27300 | 99.9% Nitrogen<br>.1% Argon<br>.1 ppm Oxygen |
| Second subsidiary stream 32 prior to subcooling in subcooler 34 | 95.60 | 5.65 | 20716 | 99.9% Nitrogen<br>1% Argon<br>.1 ppm Oxygen |
| Second subsidiary stream 32 after subcooling in subcooler 34 | 84.00 | 5.65 | 20716 | 99.9% Nitrogen<br>.1% Argon<br>.1 ppm Oxygen |
| Second subsidiary stream 32 after passage through Joule-Thompson valve 36 | 80.69 | 1.48 | 20716 | 99.9% Nitrogen<br>.1% Argon<br>.1 ppm Oxygen |
| High purity nitrogen stream 44 after vaporization within head condenser 42 | 70.85 | 1.41 | 20716 | 99.9% Nitrogen<br>.1% Argon<br>.1 ppm Oxygen |
| High purity nitrogen stream 44 after having been partially warmed in subcooler 34 | 97.08 | 1.31 | 20716 | 99.9% Nitrogen<br>.1% Argon<br>.1 ppm Oxygen |
| High purity nitrogen stream 44 after passage through main heat exchanger 20 | 295.28 | 1.21 | 20716 | 99.9% Nitrogen<br>.1% Argon<br>.1 ppm Oxygen |
| Gaseous oxygen stream 48 | 93.50 | 1.42 | 8333 | 99.9% Oxygen<br>.1% Argon<br>0% Nitrogen |
| Gaseous oxygen stream 48 after main heat exchanger 20 | 298.24 | 1.32 | 8333 | 99.9% Oxygen<br>.1% Argon<br>0% Nitrogen |
| Waste nitrogen stream 46 | 82.77 | 1.26 | 21210 | 84% Nitrogen<br>14% Oxygen<br>2% Argon |
| Waste nitrogen stream 46 after subcooler 24 | 97.08 | 1.31 | 21210 | 84% Nitrogen<br>14% Oxygen<br>2% Argon |
| Waste nitrogen stream 46 after main heat exchanger 20 | 298.24 | 1.21 | 21210 | 84% Nitrogen<br>14% Oxygen<br>2% Argon |
| Crude liquid oxygen stream 38 | 100.55 | 5.9 | 25465 | 59% Nitrogen<br>39% Oxygen<br>2% Argon |

-continued

| Stream | Temperature | Pressure | Flow Rate | Composition |
|---|---|---|---|---|
| Crude liquid oxygen stream 38 after subcooler 34 | 97 | 5.9 | 25465 | 59% Nitrogen<br>39% Oxygen<br>2% Argon |
| Crude liquid oxygen stream 38 after Joule-Thompson valve 40 | 85.19 | 1.6 | 25465 | 59% Nitrogen<br>39% Oxygen<br>2% Argon |

Although the invention has been described with reference to a preferred embodiment, it will occur to those skilled in the art that numerous changes, addition and omissions can be made without departing from the spirit and scope of the invention.

We claim:

1. A process for producing a high purity nitrogen vapor product from the rectification of air, said method comprising:

compressing the air, removing heat of compression from the air, and purifying the air;

cooling the air to a temperature suitable for its rectification in a main heat exchanger;

rectifying the air in a high pressure column of a double column air separation unit such that a crude liquid oxygen column bottom and a high purity nitrogen vapor tower overhead are formed;

further refining the crude liquid oxygen column bottom in a low pressure column of the double column air separation unit such that a liquid oxygen column bottom and a nitrogen rich tower overhead are formed, the nitrogen rich tower overhead having a higher concentration of oxygen than the high purity nitrogen vapor tower overhead produced in the high pressure column;

supplying reflux to the high pressure column by condensing the high purity nitrogen vapor tower overhead against vaporizing the liquid oxygen, withdrawing first and second subsidiary stream as composed of the condensed high purity nitrogen vapor tower overhead, and introducing the first subsidiary stream in to the high pressure column as reflux;

supplying reflux to the low pressure column by indirectly exchanging heat between the second subsidiary stream and the nitrogen rich tower overhead in the low pressure column such that the second subsidiary stream at least partially vaporizes to form the high purity nitrogen vapor stream and the nitrogen rich tower overhead partially condenses;

subcooling the crude liquid oxygen column bottom to be further refined in the low pressure column and the second subsidiary stream through indirect heat exchange with the high purity nitrogen vapor stream so that said high purity nitrogen vapor stream partially warms;

supplying refrigeration to the process; and after utilizing the high purity nitrogen vapor stream in the subcooling of the crude liquid oxygen and the second subsidiary stream, introducing the high purity nitrogen vapor stream into the main heat exchanger and withdrawing it as the high purity nitrogen vapor product.

2. The method of claim 1 wherein refrigeration is supplied to the process by extracting a partial stream of air from the main heat exchanger after it is partially cooled, expanding said partial stream with the performance of work, and introducing said partial stream, after expansion, into the low pressure column.

3. The method of claim 1 wherein:

a gaseous oxygen product stream is withdrawn from the low pressure column;

a waste nitrogen stream composed of the nitrogen-rich tower overhead is withdrawn from the low pressure column; and the air is cooled against warming the waste nitrogen, gaseous oxygen product and high purity nitrogen streams in the main heat exchanger.

4. An apparatus for separating air to produce a gaseous nitrogen product of high purity, said apparatus comprising:

means for compressing the air;

an aftercooler connected to the compressor means for removing heat of compression from the air;

purification means for purifying the air;

main heat exchange means for cooling the air to a temperature suitable for its rectification and for warming to ambient a high purity nitrogen vapor stream comprising the gaseous nitrogen product of high purity;

an air separation unit for rectifying the air, said air separation unit having high and low pressure columns operatively associated with one another in a heat transfer relationship by provision of a condenser-reboiler and having contacting elements for contacting an ascending vapor phase becoming more concentrated in nitrogen vapor as it ascends with a descending liquid phase becoming more concentrated in liquid oxygen at it descends;

the high pressure column connected to the main heat exchange means so as to receive the air and having a sufficient number of theoretical stages of separation provided by the contacting elements such that a high purity nitrogen vapor tower overhead and a crude liquid oxygen column bottom are produced in the high pressure column from the rectification of the air, the high purity nitrogen vapor tower overhead condensed against vaporization of liquid oxygen produced in the low pressure column by the condenser-reboiler;

the high pressure column connected to the condenser-reboiler so that a first subsidiary stream, composed of the high purity nitrogen vapor tower overhead, flows into the high pressure column as reflux;

the low pressure column connected to the high pressure column so as to receive a crude liquid oxygen stream composed of the crude liquid oxygen column bottom and having a sufficiently low number of theoretical stages of separation provided by the contacting elements such that a lower purity nitrogen vapor tower overhead and a liquid oxygen column bottom are produced;

condensing means connected to the condenser-reboiler and low pressure columns for at least partially vaporizing a second subsidiary stream, composed of the condensed high purity nitrogen vapor tower overhead, thereby to produce the high purity nitrogen vapor stream, against partially condensing the lower purity nitrogen vapor tower overhead through indirect heat exchange;

subcooling means for indirectly exchanging heat between the high purity nitrogen vapor stream and the second subsidiary and crude oxygen streams so that the high purity nitrogen vapor stream partially warms and the second subsidiary and crude oxygen streams subcool;

the subcooling means connected to the main heat exchange means so that the high purity nitrogen vapor stream fully warms in the main heat exchange means; and refrigeration means for adding refrigeration to the apparatus.

5. The apparatus of claim 4 wherein the refrigeration means comprises a turboexpander connected to the main heat exchange means so that a partial stream of air after having been partially cooled is expanded with the performance of work and introduced into the low pressure column.

6. The apparatus of claim 4 wherein the contacting elements comprise structured packing.

* * * * *